US010858974B1

(12) United States Patent
Hoffman et al.

(10) Patent No.: US 10,858,974 B1
(45) Date of Patent: Dec. 8, 2020

(54) LUBRICANT COOLERS FOR MARINE ENGINES

(71) Applicant: Brunswick Corporation, Mettawa, IL (US)

(72) Inventors: Daniel P. Hoffman, Fond du Lac, WI (US); Thomas F. Nickols, Oakfield, WI (US); Alex Andrej Shozda, Schaumburg, IL (US)

(73) Assignee: Brunswick Corporation, Mettawa, IL (US)

( * ) Notice: Subject to any disclaimer, the term of this patent is extended or adjusted under 35 U.S.C. 154(b) by 73 days.

(21) Appl. No.: 16/128,719

(22) Filed: Sep. 12, 2018

(51) Int. Cl.

| | |
|---|---|
| ***F02B 75/22*** | (2006.01) |
| ***F01M 5/00*** | (2006.01) |
| ***B63H 20/00*** | (2006.01) |
| ***F01M 11/02*** | (2006.01) |
| ***F01M 1/02*** | (2006.01) |
| *F01M 11/00* | (2006.01) |
| *F02F 7/00* | (2006.01) |

(52) U.S. Cl.
CPC ..... *F01M 5/002* (2013.01); *B63H 20/002* (2013.01); *F01M 1/02* (2013.01); *F01M 11/02* (2013.01); *F02B 75/22* (2013.01); *F01M 11/0004* (2013.01); *F02F 7/0053* (2013.01)

(58) Field of Classification Search
CPC ..... F01M 5/002; F01M 1/02; F01M 11/02; F01M 11/0004; B63H 20/002; F02B 75/22
See application file for complete search history.

(56) References Cited

U.S. PATENT DOCUMENTS

| | | | | |
|---|---|---|---|---|
| 6,571,763 | B1 * | 6/2003 | Bakker | F01M 11/02 123/195 R |
| 7,178,500 | B1 * | 2/2007 | Belter | F01M 5/002 123/195 R |
| 7,370,311 | B1 | 5/2008 | Pritchard et al. | |
| 7,398,745 | B1 | 7/2008 | White et al. | |
| 8,500,501 | B1 | 8/2013 | Taylor et al. | |
| 9,457,881 | B1 | 10/2016 | Belter et al. | |
| 9,944,373 | B1 | 4/2018 | Kollock et al. | |
| 10,006,419 | B1 | 6/2018 | Hoffman et al. | |
| 2015/0047583 | A1 * | 2/2015 | Palazzolo | F02B 75/22 123/52.1 |

* cited by examiner

*Primary Examiner* — Syed O Hasan
(74) *Attorney, Agent, or Firm* — Andrus Intellectual Property Law, LLP

(57) ABSTRACT

A marine engine has a cylinder block comprising first and second banks of cylinders disposed along a longitudinal axis and extending transversely with respect to each other in a V-shape so as to define a valley there between; and a lubricant cooler located in the valley and extending parallel to the longitudinal axis. The lubricant cooler has a lubricant conduit that conveys engine lubricant parallel to the longitudinal axis and then transversely to the longitudinal axis to the cylinder block. The lubricant cooler further has a cooling conduit that conveys cooling fluid alongside the lubricant conduit to thereby cool the lubricant conduit and the engine lubricant therein.

15 Claims, 7 Drawing Sheets

LUBRICANT COOLERS FOR MARINE ENGINES

FIELD

The present disclosure relates to marine engines and particularly to coolers for cooling lubricant for marine engines.

BACKGROUND

The following U.S. Patents are incorporated herein by reference:

U.S. Pat. No. 10,006,419 discloses an outboard marine engine having a crankcase; a crankshaft disposed in the crankcase and being rotatable about a crankshaft axis; a crankcase cover on the crankcase, the crankcase cover enclosing the crankshaft in the crankcase; and an air intake plenum that is integrally formed with the crankcase cover. The air intake plenum conveys intake air for combustion in the outboard marine engine.

U.S. Pat. No. 9,457,881 discloses an outboard marine engine having an engine block; a crankcase on the engine block; a crankshaft disposed in the crankcase for rotation about a crankshaft axis; a cover on the crankcase; a bedplate disposed between the engine block and the cover, the bedplate having a plurality of bearings for supporting rotation of the crankshaft; and a cooling water jacket that extends parallel to the crankshaft axis along a radially outer portion of the plurality of bearings. The cooling water jacket carries cooling water for cooling the plurality of bearings and an oil drain-back area is located adjacent to the cooling water jacket. The at least one oil drain-back area drains oil from the crankcase.

U.S. Pat. No. 9,944,373 discloses an outboard marine engine having a vertically aligned bank of piston-cylinders; a camshaft that operates a plurality of valves for controlling flow of air with respect to the vertically aligned bank of piston-cylinders, the camshaft vertically extending between a lower camshaft end and an upper camshaft end; and a cam lobe at the upper camshaft end. Rotation of the camshaft causes the cam lobe to cam open an uppermost valve in the plurality of valves. A lubricant circuit extends through the camshaft and has a lubricant outlet located at the upper camshaft end. The lubricant outlet is configured to disperse lubricant onto the uppermost valve, which is located above an uppermost cam bearing bulkhead for the upper camshaft end.

U.S. Pat. No. 8,500,501 discloses an outboard marine drive having a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A three-pass exhaust manifold is provided. A method is provided for preventing condensate formation in a cylinder head, catalyst housing, and exhaust manifold of an internal combustion engine of a powerhead in an outboard marine drive.

U.S. Pat. Nos. 7,370,311 and 7,398,745 disclose a cooling system for a marine propulsion device that provides a bypass loop around a cooling pump that allows the flow of cooling water through certain components to be reduced or increased as a function of the temperature of those components while causing a full flow of cooling water to flow through other selected heat emitting devices. Using this configuration of components and bypass conduits, the operating condition of the cooling water pump can be continually monitored, including the condition of its flexible vanes. By observing the effective cooling capacity of the system under conditions with the bypass valve open and closed, the effectiveness of the cooling water pump can be assessed and a suggestion of maintenance can be provided.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A marine engine has a cylinder block comprising first and second banks of cylinders disposed along a longitudinal axis and extending transversely with respect to each other in a V-shape so as to define a valley there between; and a lubricant cooler located in the valley and extending parallel to the longitudinal axis. The lubricant cooler has a lubricant conduit that conveys engine lubricant parallel to the longitudinal axis and then transversely to the longitudinal axis into the cylinder block. The lubricant cooler further has a cooling conduit that conveys cooling fluid alongside the lubricant conduit to thereby cool the lubricant conduit and the engine lubricant therein.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION OF THE DRAWINGS

Figure 1:
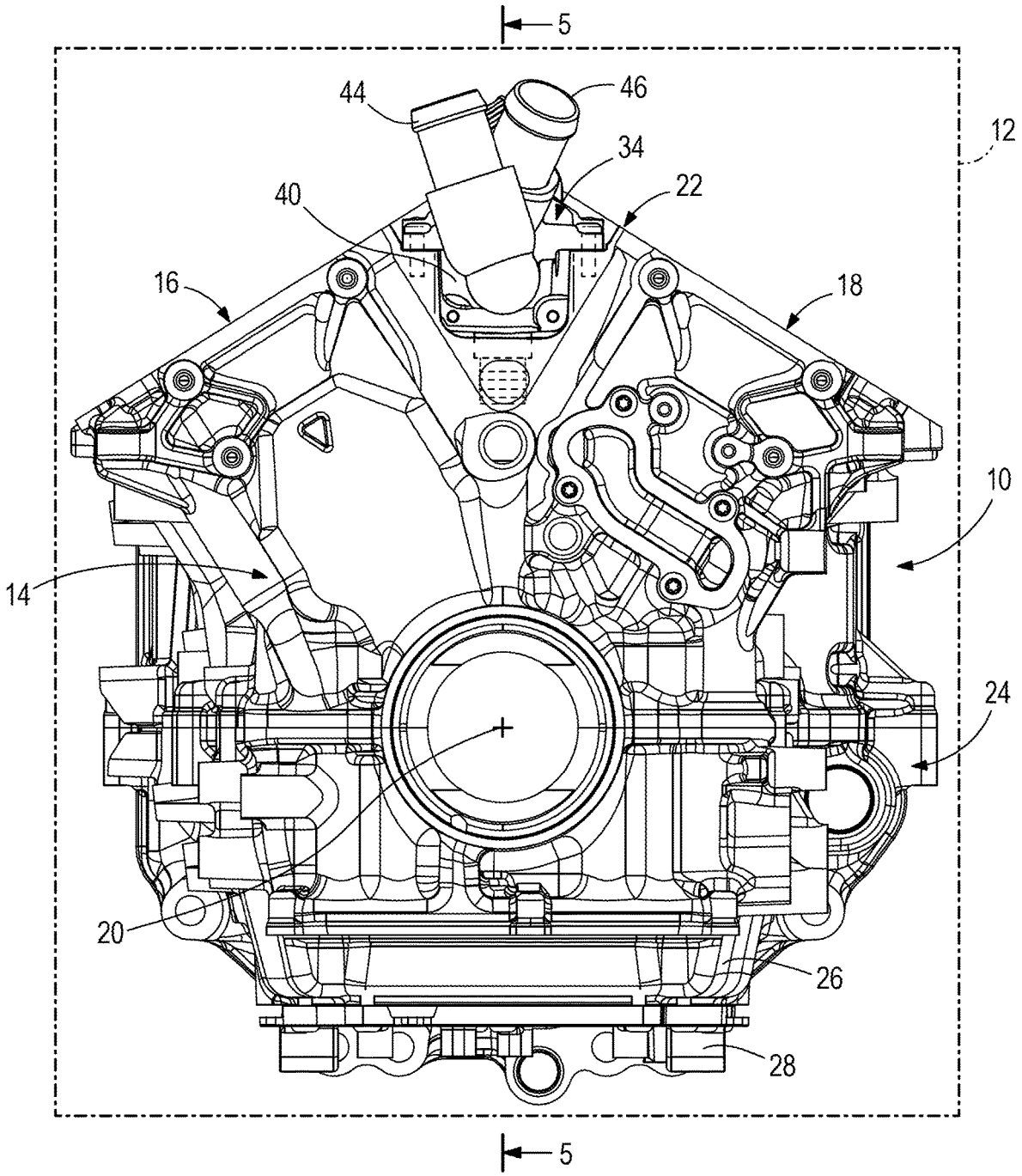
FIG. 1 is an end view of a V-shaped marine engine according to the present disclosure, showing a lubricant cooler disposed in the valley of the V-shape.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Figure 2:
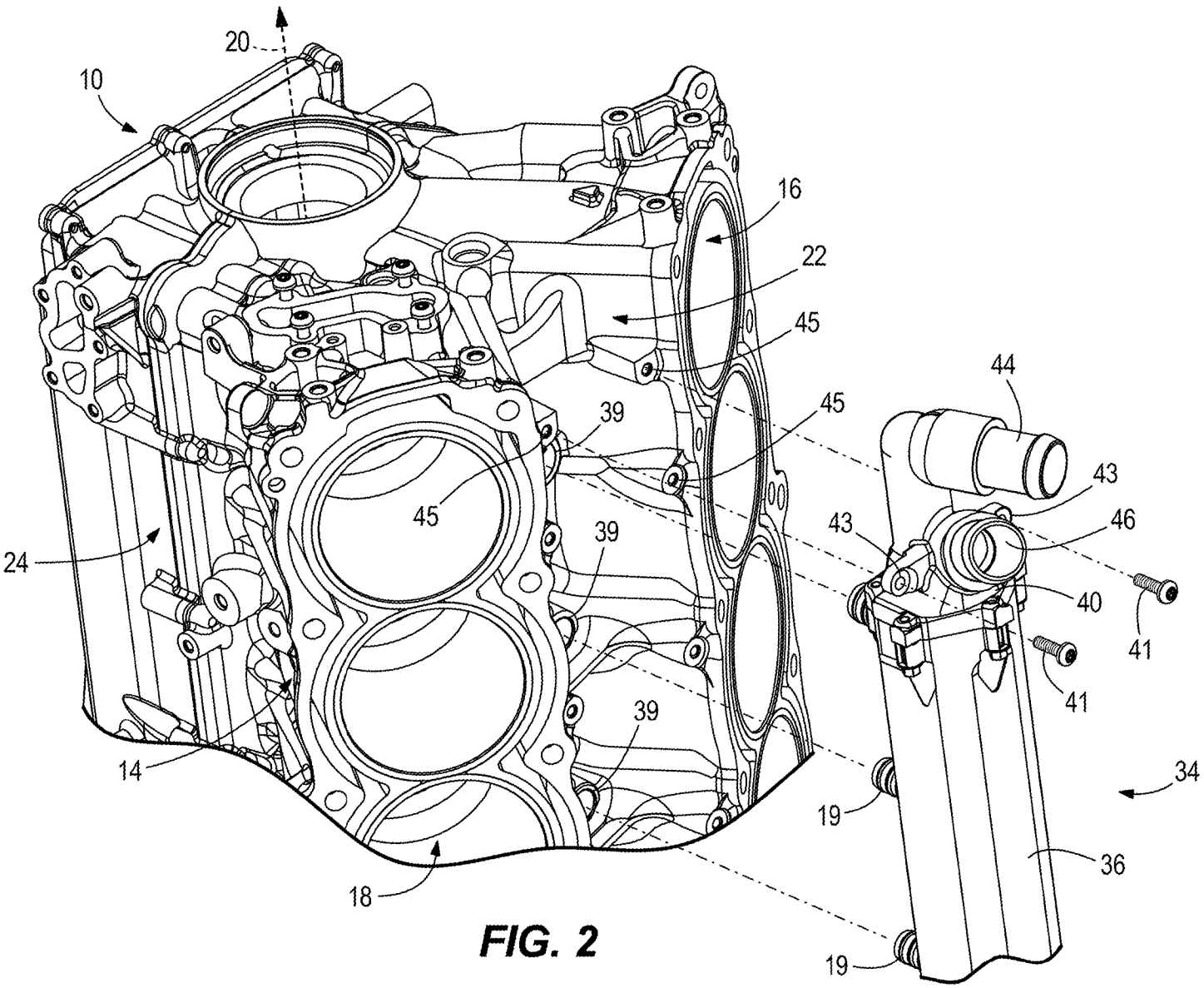
FIG. 2 is an exploded view, showing the lubricant cooler exploded away from the valley.

FIGS. 1 and 2 depict an internal combustion engine 10 for use in a marine drive 12, which for example can be an outboard motor or stern drive, or any other type of marine drive. The engine 10 includes a cylinder block 14 having first and second banks of cylinders 16, 18. The first and second banks of cylinders 16, 18 are disposed along a longitudinal axis 20 and extend transversely with respect to each other in a V-shape so as to define a valley 22 there between. This is commonly referred to in the art as a V-style engine. In the illustrated example, the engine 10 has eight cylinders (i.e. V-8); however the number of cylinders can vary and for example can be four cylinders (V-4), six cylinders (V-6), ten cylinders (V-10), etc. The illustrated example depicts an outboard motor configuration wherein the longitudinal axis 20 extends generally vertically, as shown in FIG. 2.

As is conventional, combustion of fuel in the engine 10 causes pistons within the cylinders 16, 18 to reciprocate. This in turn causes rotation of a crankshaft about the longitudinal axis 20. The pistons, crankshaft and associated connecting rods are not shown in the drawings; however these components are well known in the art and are more fully described in the above-incorporated U.S. patents and/or many other patents owned by Brunswick Corporation. In the illustrated example, the engine 10 further includes a crankcase 24, bedplate 26, and crankcase cover 28. The crankcase cover 28 closes the crankcase 24 and together with the crankcase 24 and bedplate 26 defines an interior volume 30 (see FIG. 5) which contains the crankshaft and engine lubricant (e.g., oil) for lubricating and facilitating rotation of the crankshaft with respect to main bearings 32, which are interdigitated amongst the cylinders 16, 18 and support the crankshaft. The crankcase cover 28 is fastened to the bedplate 26, which in turn is fastened to the crankcase 24.

According to the present disclosure, a lubricant cooler 34 is located in the valley 22 and extends generally parallel to the longitudinal axis 20. The lubricant cooler 34 is for cooling relatively hot lubricant prior to its supply to the main bearings 32 and interior volume 30. The lubricant cooler 34 is a principle subject of the present disclosure and is further described herein below.

Through research and experimentation, the present inventors have determined that there is limited space in marine engines, and particularly in outboard motors. The present inventors have determined that there often is very little available space to efficiently package a lubricant cooler for cooling lubricant supplied to the engine 10. The present inventors have also determined that while it is possible to locate the lubricant cooler in the valley 22 of the engine 10, this presents challenges. For example, over-cooling of the cylinder block in the valley can cause thermal stress and structural fatigue. The relatively hot crankcase-side of the cylinder block tends to expand, while the relatively cold valley-side of the cylinder block tends to maintain its size. The non-uniformity of metal temperatures causes the cylinder block to fatigue over time. However, locating the lubricant cooler elsewhere on the marine drive can reduce effectivity of the lubricant cooler. The present disclosure is a result of the inventors' efforts to overcome these challenges.

Figure 3:
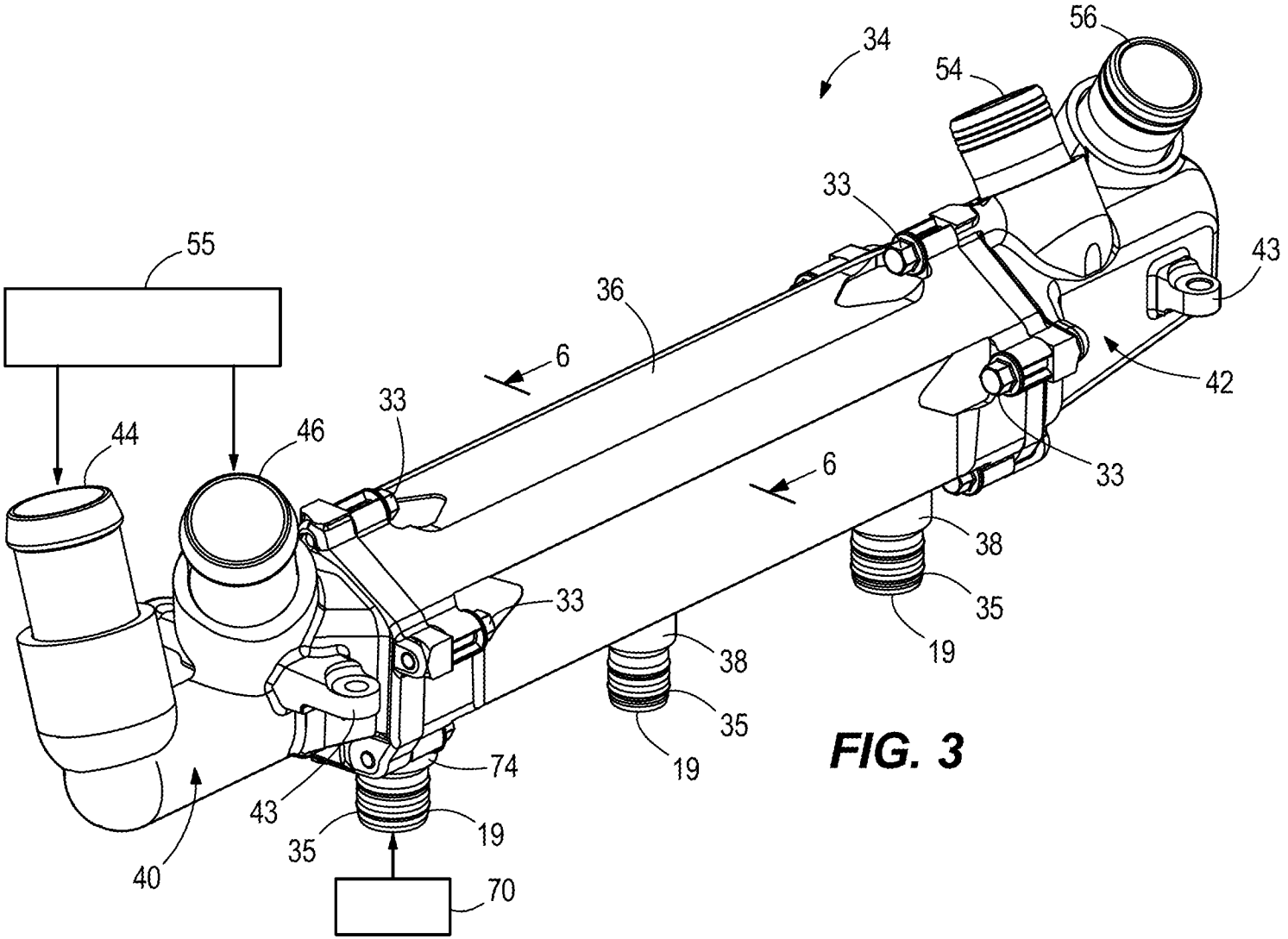
FIG. 3 is a perspective view of the lubricant cooler.
Figure 4:
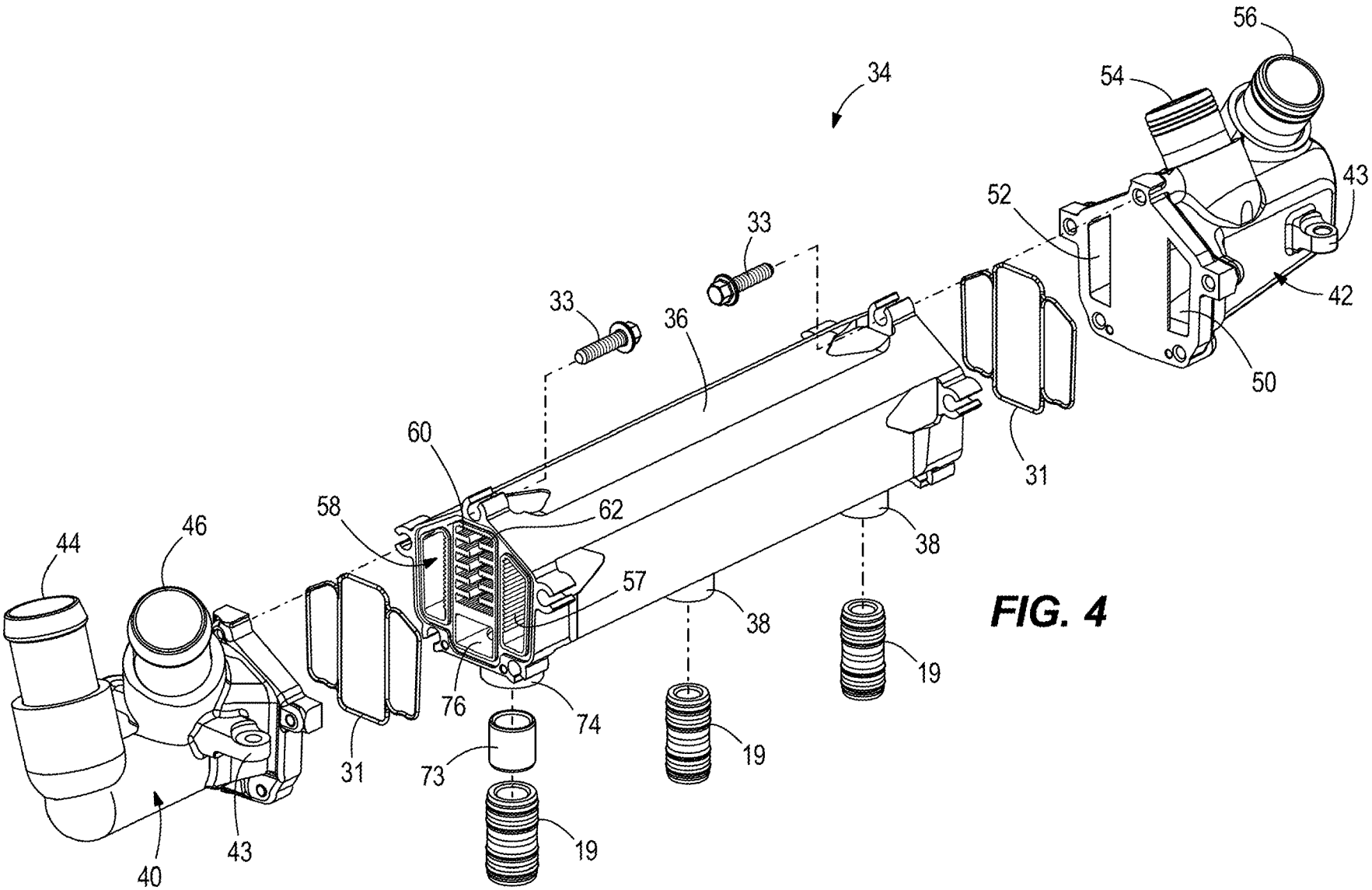
FIG. 4 is an exploded view of the lubricant cooler.

Referring to FIGS. 2-4, the lubricant cooler 34 has an elongated monolithic body 36 that extends along the valley 22, parallel to the longitudinal axis 20 (here, generally vertically). Outlet bosses 38 extend from the body 36 and are mated with inlet bosses 39 on the cylinder block 14 via connecting sleeves 19. Radial seals 35 (see FIG. 6) are disposed on the connecting sleeves 19 and between the bosses 38, 39 and provide a fluid-tight seal there between. In the illustrated example, the elongated body 36 is a metal extrusion, for example made of aluminum. Fasteners 41 (see FIG. 2) extend through eyelets 43 on the elongated body 36 and are fastened to corresponding bore holes 45 in the valley 22. Along with the bosses 38, 39 and connecting sleeves 19, the fasteners 41 couple the lubricant cooler 34 to the cylinder block 14.

Referring to FIGS. 4-7, the lubricant cooler 34 has upstream and downstream end caps 40, 42 that are fastened to longitudinally opposite sides of the body 36 by fasteners 33. Face seals 31 (see FIG. 4) are disposed between the end faces of the upstream and downstream end caps 40, 42 and the opposite sides of the body 36, respectively, and provide a fluid-tight seal there between. The upstream end cap 40 has a pair of inlet ports 44, 46 that feed cooling water to a manifold 48. The downstream end cap 42 has a pair of outlet conduits 50, 52 that feed cooling water from the body 36 in parallel to a pair of outlet ports 54, 56 for discharge from the lubricant cooler 34. In a non-limiting example, the cooling water can be pumped to the inlet ports 44, 46 from a cooling water jacket on an exhaust manifold associated with the marine drive, such as is disclosed in the above-incorporated U.S. Pat. No. 8,500,501. In other non-limiting examples, the cooling water can be supplied from other cooling water jackets and/or components associated with the marine drive and/or directly from the body of water in which the associated marine vessel is operated.

FIG. 3 schematically depicts a conventional cooling water pump 55 for pumping the cooling water through the lubricant cooler 34. The cooling water pump 55 can for example be any suitable mechanically and/or electrically powered pump and can be located on the marine drive or remotely from the marine drive. Referring to FIGS. 4-7, the body 36 has first and second cooling water passages 57, 58 that longitudinally extend through the body 36 and convey cooling water in parallel from the manifold 48 in the upstream end cap 40 to the outlet conduits 50, 52 in the downstream end cap 42. The cooling water is pumped into the manifold 48 and then is bifurcated into the first and second cooling water passages 57, 58, which feed the respective outlet conduits 50, 52 and outlet ports 54, 56. As the relatively cold cooling water travels through the cooling water passages 57, 58 it exchanges heat with the sidewalls of the respective cooling water passages 57, 58, which in turn cools the lubricant flowing through the body 36, as further described herein below.

Figure 5:
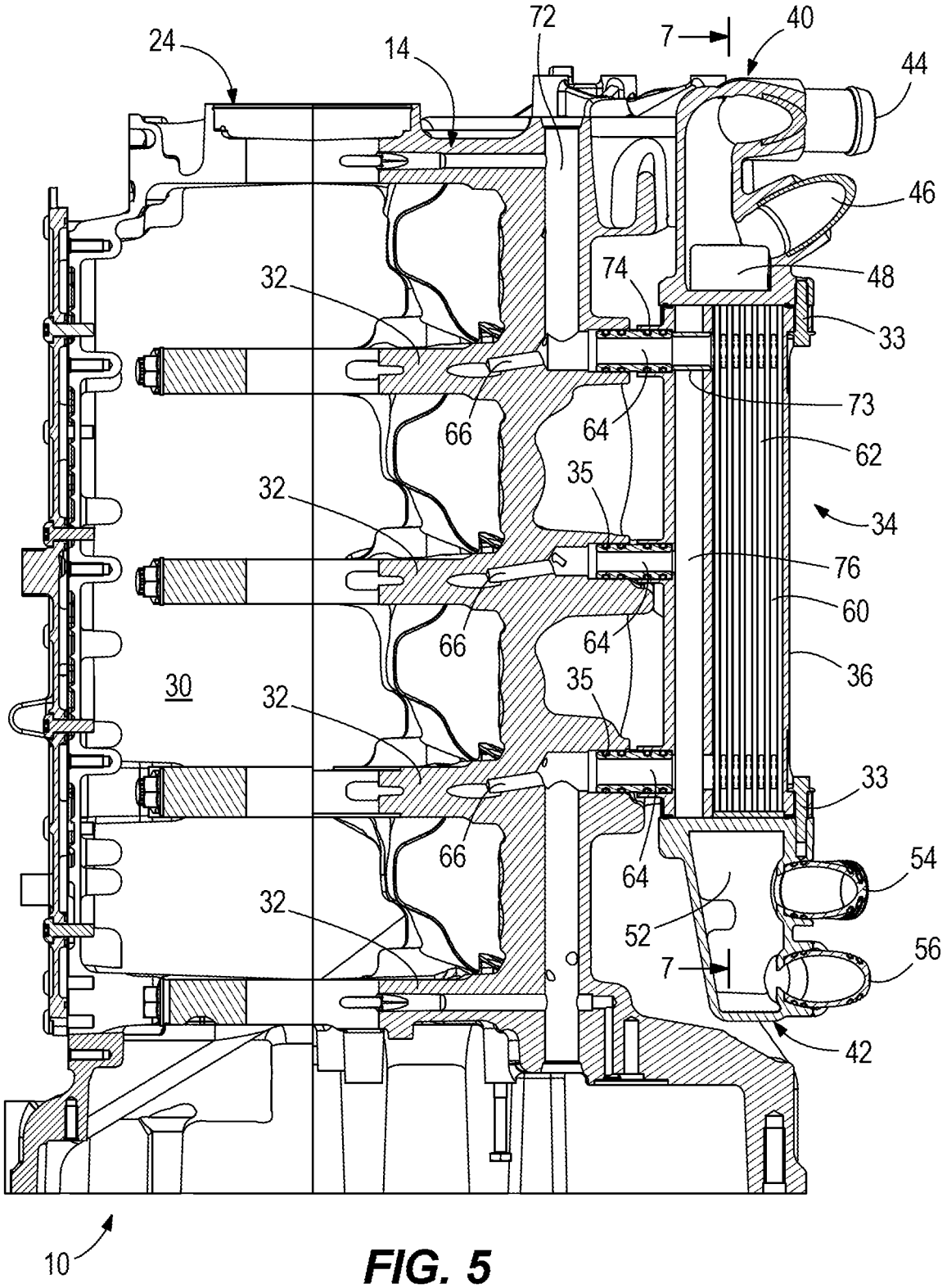
FIG. 5 is a view of Section 5-5, taken in FIG. 1.

Referring to FIGS. 4-7, the lubricant cooler 34 has a lubricant conduit 60 that conveys engine lubricant parallel to the longitudinal axis 20 and then transversely (here radially) to the cylinder block 14 via the bosses 38. The lubricant conduit 60 includes a main lubricant passage 62 that longitudinally conveys the lubricant downwardly through the lubricant cooler 34 and lateral lubricant passages 64 that laterally convey the lubricant from the body 36 via bosses 38, transversely to the longitudinal axis 20. Referring to FIG. 5, the lateral lubricant passages 64 feed the lubricant to radially extending lubricant passages 66 in the cylinder block 14, which in turn feed the lubricant to the main bearings 32. The lubricant is conveyed through the main bearings 32 to the interior volume 30, from which the lubricant drains by gravity to an underlying lubricant sump.

Referring to FIGS. 3 and 5, a conventional lubricant pump 70 (shown schematically in FIG. 3) pumps the lubricant into the lubricant cooler 34 via a passage 72 (shown in FIG. 5) in the cylinder block 14 connected to an inlet boss 74 on the lubricant cooler 34. The lubricant pump 70 is a conventional item and can be any suitable electrically or mechanically powered pump and can be located on the marine drive or remotely from the marine drive. A connecting sleeve 73 laterally extends through the body 36 to the main lubricant passage 62 so that the lubricant is conveyed from the passage 72 to the main lubricant passage 62. It is not essential that the lubricant flow through the cylinder block 14 to the upstream of the lubricant cooler 34. In other examples, the lubricant can be fed to the lubricant cooler 34 via a separate line, inside and/or outside of the cylinder block 14.

Figure 6:
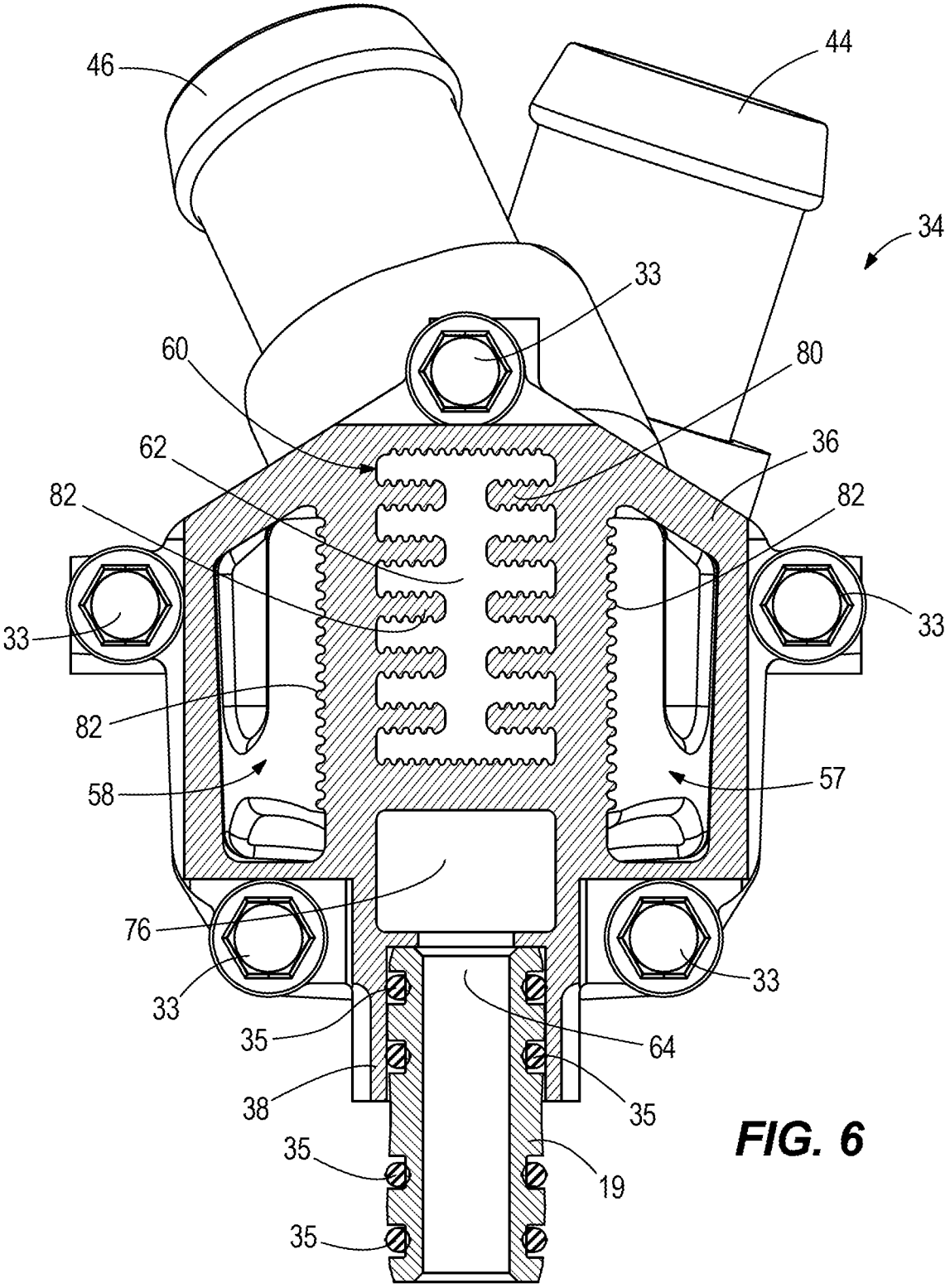
FIG. 6 is a view of Section 6-6, taken in FIG. 3.
Figure 7:
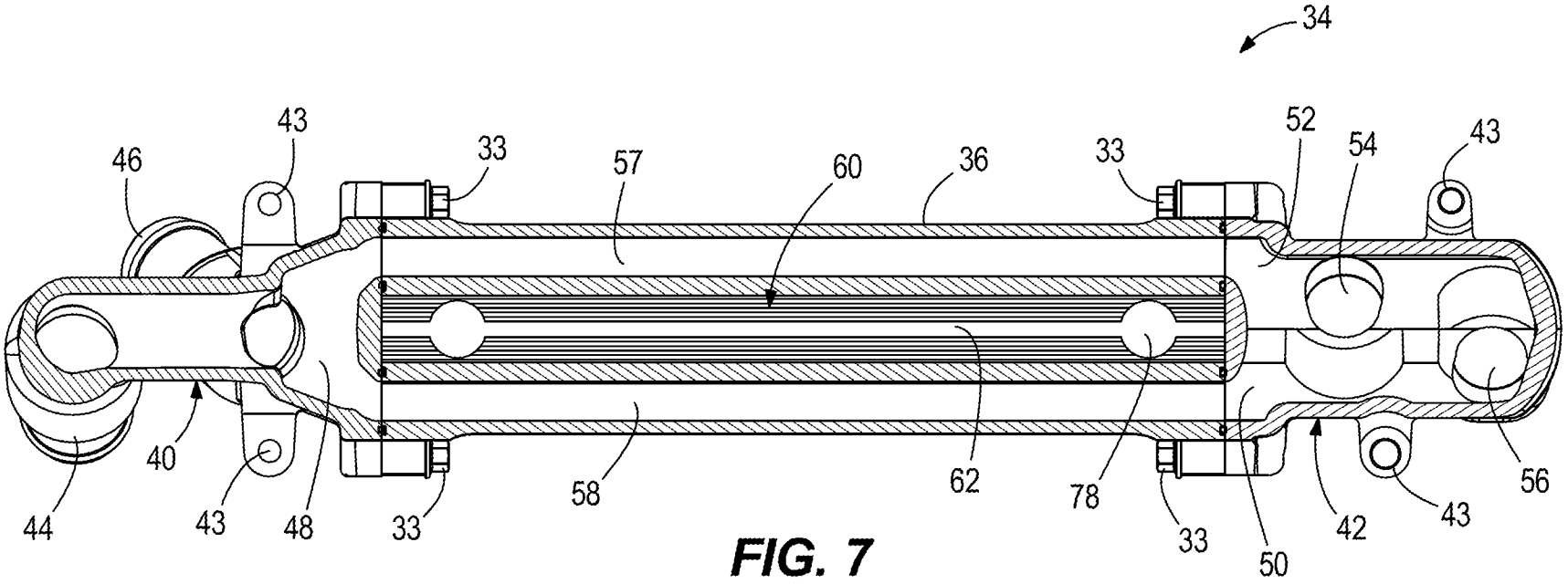
FIG. 7 is a view of Section 7-7, taken in FIG. 5.

In the illustrated example, the main lubricant passage 62 is connected to a secondary lubricant passage 76 that extends alongside the main lubricant passage 62, generally parallel to the longitudinal axis 20, and laterally in between the main lubricant passage 62 and the cylinder block 14. The main lubricant passage 62 conveys lubricant from the lubricant pump 70 downwardly with respect to the longitudinal axis 20 and then back upwardly with respect to the longitudinal axis 20. A connecting passage 78 (see FIG. 7) is located at the lower end of the body 36 and connects the main lubricant passage 62 and secondary lubricant passage 76. The connecting passage 78 allows the lubricant to reverse directions with respect to the longitudinal axis 20, here from a downward flow to an upward flow. The lateral lubricant passages 64 are connected to the secondary lubricant passage 76 and convey the lubricant transversely (radially) into the engine block via the bosses 38 and into the radially extending lubricant passages 66. As best seen in FIG. 6, the first and second cooling water passages 57, 58 are located on opposite sides of the main lubricant passage 62 and secondary lubricant passage 76 such that the respective passages share sidewalls, which facilitates heat exchange between the relatively cold cooling water conveyed in the first and second cooling water passages 57, 58 and the relatively hot lubricant conveyed in the main and secondary lubricant passages 62, 76. Opposing fins 80, 82 extend into the main lubricant passage 62 from opposing sidewalls and provide an increased surface area contact between the lubricant and the sidewalls of the main lubricant passage 62, thus facilitating better heat exchange as compared to a flat sidewall configuration. The interior sidewalls of the first and second cooling water passages 57, 58 also have fins 82, which provides increased surface area contact and facilitating better heat exchange as compared to a flat sidewall configuration. Optionally, a thermal shield can be located between the lubricant cooler 34 and the cylinder block 14, for reducing thermal conduction between the lubricant cooler 34 and cylinder block 14.

Thus, in operation, the cooling water pump 55 pumps cooling water from upstream to downstream through the lubricant cooler 34, and particularly into the pair of inlet ports 44, 46 through the manifold 48, through the first and second cooling water passages 57, 58, and through the outlet conduits 50, 52 and outlet ports 54, 56. At the same time, the lubricant pump 70 pumps lubricant through the passage 72, through the inlet boss 74 and connecting sleeve 73, into the main lubricant passage 62, around the connecting passage 78, through the secondary lubricant passage 76, radially into the radially extending lubricant passages 66 via the lateral lubricant passages 64, and onto the main bearings 32 and into the interior volume 30 from which the lubricant drains by gravity to the noted underlying lubricant sump.

Thus, the present disclosure provides embodiments of a lubricant cooler located in the valley of the V-shaped marine engine, which minimizes the above disadvantages regarding non-uniformity of metal temperatures, thermal stress and structural fatigue. The arrangements disclosed herein provide an efficient use of packaging space in, for example outboard motor marine drive arrangements.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A marine engine comprising: a cylinder block comprising first and second banks of cylinders disposed along a longitudinal axis and extending transversely with respect to each other in a V-shape so as to define a valley there between; and a lubricant cooler located in the valley and extending parallel to the longitudinal axis, the lubricant cooler comprising a lubricant conduit that conveys engine lubricant parallel to the longitudinal axis and then transversely to the longitudinal axis to the cylinder block, and the lubricant cooler further comprising a cooling passage that conveys cooling fluid alongside the lubricant conduit to thereby cool the lubricant conduit and the engine lubricant therein, wherein the cylinder block comprises a plurality of bearings that are interdigitated amongst the plurality of cylinders, wherein the lubricant conduit of the lubricant cooler comprises a main lubricant passage that conveys the engine lubricant longitudinally through the lubricant cooler and a plurality of lateral passages that each transversely convey the engine lubricant from the main lubricant passage to a respective bearing in the plurality of bearings in the cylinder block, wherein the lubricant cooler comprises an elongated body that extends along the valley and a plurality of bosses that transversely extend from the elongated body and are mated with the cylinder block, and wherein the plurality of lateral passages extends through the plurality of bosses.

2. The marine engine according to claim 1, wherein the body comprises a monolithic metal extrusion.

3. The marine engine according to claim 1, further comprising a crankcase, wherein the engine lubricant is conveyed from the plurality of bearings to the crankcase and then drains by gravity to a lubricant sump.

4. The marine engine according to claim 1, further comprising a plurality of cooling fins that laterally extend into the main lubricant passage and facilitate heat exchange between the engine lubricant and the cooling fluid.

5. A marine engine comprising:

a cylinder block comprising first and second banks of cylinders disposed along a longitudinal axis and extending transversely with respect to each other in a V-shape so as to define a valley there between;

a lubricant cooler located in the valley and extending parallel to the longitudinal axis, the lubricant cooler comprising a lubricant conduit that conveys engine lubricant parallel to the longitudinal axis and then transversely to the longitudinal axis to the cylinder block, the lubricant cooler further comprising a cooling passage that conveys cooling fluid alongside the lubricant conduit to thereby cool the lubricant conduit and the engine lubricant therein;

wherein the cylinder block comprises a plurality of bearings that are interdigitated amongst the plurality of cylinders, and wherein the lubricant conduit comprises a main lubricant passage that conveys the engine lubricant longitudinally through the lubricant cooler and a plurality of lateral passages that transversely convey the engine lubricant to the plurality of bearings; and a plurality of cooling fins that laterally extend into the main lubricant passage and facilitate heat exchange between the engine lubricant and the cooling fluid;

wherein the plurality of cooling fins comprises first and second stacks of opposing fins.

6. The marine engine according to claim 1, wherein the main lubricant passage is connected to a secondary lubricant passage that extends alongside the main lubricant passage, the secondary lubricant passage being connected to the plurality of lateral lubricant passages.

7. The marine engine according to claim 6, further comprising a lubricant pump that pumps the engine lubricant through the main lubricant passage in a first direction with respect to the longitudinal axis and then in an opposite second direction with respect to the longitudinal axis, and then transversely through the plurality of lateral lubricant passages.

8. The marine engine according to claim 1, wherein the cooling passage is one of a first cooling passage located on a first side of the main lubricant passage and a second passage located on an opposite, second side of the main lubricant passage.

9. The marine engine according to claim 8, further comprising a pump that pumps the cooling fluid through the first and second cooling passages parallel to the longitudinal axis.

10. The marine engine according to claim 8, further comprising a manifold upstream of the first and second cooling passages, wherein cooling fluid from the lubricant pump enters the manifold and is bifurcated into the first and second cooling passages.

11. The marine engine according to claim 10, further comprising a pair of inlet ports that supply the cooling fluid to the manifold.

12. The marine engine according to claim 1, further comprising a shield located between the lubricant cooler and the cylinder block, wherein the shield reduces thermal conduction between the lubricant cooler and the engine block.

13. A lubricant cooler for a marine engine having a cylinder block comprising first and second banks of cylinders disposed along a longitudinal axis and extending transversely with respect to each other in a V-shape so as to define a valley there between, the lubricant cooler comprising an elongated body for extending along the valley; a plurality of bosses that transversely extend from the elongated body and are for mating with the cylinder block; a main lubricant passage that conveys the engine lubricant longitudinally through the elongated body, and a plurality of lateral passages configured to convey the engine lubricant transversely into the cylinder block via the bosses, and wherein the plurality of lateral passages extends through the plurality of bosses.

14. The marine engine according to claim 13, wherein the body comprises a monolithic metal extrusion.

15. The marine engine according to claim 13, further comprising a plurality of cooling fins that laterally extend into the main lubricant passage and facilitate heat exchange between the engine lubricant and the cooling fluid.

* * * * *